United States Patent [19]

Rautio

[11] Patent Number: 4,709,609

[45] Date of Patent: Dec. 1, 1987

[54] SAW MACHINE

[76] Inventor: Kauko Rautio, Kolmihaarantie, 52700 Mäntyharju, Finland

[21] Appl. No.: 940,183

[22] Filed: Dec. 9, 1986

Related U.S. Application Data

[63] Continuation of Ser. No. 783,321, Oct. 2, 1985, abandoned, which is a continuation of Ser. No. 566,683, Dec. 29, 1983, abandoned.

[30] Foreign Application Priority Data

Dec. 30, 1982 [FI] Finland ..... 824522

[51] Int. Cl.[4] ..... B26D 7/06; B27B 13/00

[52] U.S. Cl. ..... 83/435.2; 83/409; 83/435; 83/732; 144/245 A; 144/242 D; 198/626; 198/605

[58] Field of Search ..... 83/435.2, 436, 424, 83/409, 435, 437, 155, 155.1, 732; 144/245 A, 242 D, 39, 41, 3 P, 376; 209/521; 198/626-628, 836, 605, 746

[56] References Cited

U.S. PATENT DOCUMENTS

| | | | |
|---|---|---|---|
| 799,836 | 9/1905 | Dittbenner | 83/435.2 X |
| 993,173 | 5/1911 | Karhu | 83/435.2 X |
| 2,780,253 | 2/1957 | Joa | 83/436 X |
| 2,821,220 | 1/1958 | Nicholson | 83/436 |
| 3,131,734 | 5/1964 | Robbins | 83/435.2 X |
| 3,310,079 | 3/1967 | Mater | 83/155 X |
| 3,844,399 | 10/1974 | Sellers et al. | 198/624 |
| 3,866,640 | 2/1975 | Sweet et al. | 144/3 P |
| 4,146,072 | 3/1979 | Detjen | 144/39 |

FOREIGN PATENT DOCUMENTS

| | | | |
|---|---|---|---|
| 1104904 | 11/1955 | France . | |
| 955790 | 4/1964 | United Kingdom | 144/3 P |

*Primary Examiner*—E. R. Kazenske
*Assistant Examiner*—Eugenia A. Jones
*Attorney, Agent, or Firm*—Martin Smolowitz

[57] ABSTRACT

A sawing machine having rollers which laterally guide a log and feed it upon a transporting chain between and under rollers to sawblades of the saw machine, such as circular saws or a band saw. Above the log there in a staying chain which stays the log by means of staying spikes acting on the log's surface. The feed chain below the log carries supporting members which support the log at a plurality of points and maintain its unchanged position relative to the sawblades, and are particularly useful for sawing crooked logs to avoid uneven and unaesthetic saw cuts.

7 Claims, 2 Drawing Figures

SAW MACHINE

This application is a continuation of application Ser. No. 783,321, filed Oct. 2, 1985 (abandoned) which is a continuation of Ser. No. 566,683 filed 12/29/83 (abandoned).

The present invention concerns a saw machine having rollers which provide lateral guiding of a log and help feed it forward, the log being forwarded upon a transporting chain assembly provided between and below said rollers, to the sawblades of the saw machine, for instance to a band saw or to circular saws, and wherein there is provided above the log a staying chain for staying the log by the aid of staying spikes directed against the surface of the log.

Saw machines of this type which are known in the art have the drawback that the log travels without guidance in the vertical direction, as it passes forward between the supporting rollers. As a consequence, it is naturally only possible to dress the vertical sides of the log, e.g. by chipping the slabs and cutting side boards. But the side boards cannot be trimmed in the same feed cycle, because the log is not vertically centered.

SUMMARY OF INVENTION

The object of this invention is to provide a new type of saw machine wherein a log can be directly guided to the sawblades, e.g. a profiling/band saw or circular saw+cutter combination, where the side boards can be trimmed from the log. The saw machine of the invention is characterized in that the feed chain assembly under the log carries supporting members adapting to the surface of the log, and which support the log at a plurality of points and keep its vertical position unchanged relative to the sawblades. With the aid of the invention, the log is therefore held in an unchanged position throughout the sawing process. Quite obviously, the result of the sawing operation will then be more accurate and provide first-class results.

An advantageous embodiment of the feed chain invention is characterized in that the supporting members consist of spikes which are turnable about a shaft transverse to the direction of travel of the log and journalled to the feed chain. These spikes assume a position in which they touch the surface of the log and lie at a slant with reference to the direction of travel, either forward or backward. It is thus understood that the log is firmly impacted between spikes both underneath and on top, whereby the supporting of the log and its feeding may both take place by the aid of the same supporting members.

Another embodiment of the invention is characterized in that the feed chain assembly has been divided into two parts or sections: a part in front of the sawblades, and a part lying after the saw blades. Thus it becomes possible freely to displace and change the sawblade between these feed chain sections.

DESCRIPTION OF INVENTION

Figure 1:
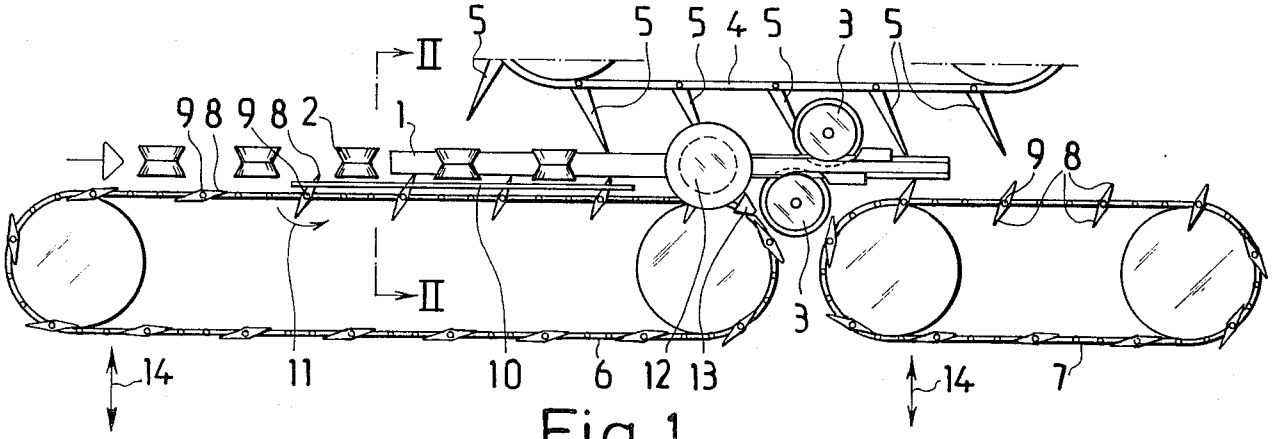
Figure 2:
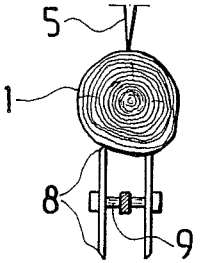

The invention is described in the following with the aid of an example, with reference being made to the attached drawing, wherein FIG. 1 presents the most important components of the saw machine, simplified and, shows in elevational view FIG. 2 shows the section carried along the line II—II in FIG. 1.

The saw machine is provided with rollers 2 for guiding and feeding the log 1 to sawblades 3,, between these rollers the log being maintained in an optimum position in the lateral and vertical directions. Above the log, there is provided a staying chain 4 for staying the log, with staying spikes 5 of chain 4 acting against the surface of the log. Underneath the log 1, there is an endless feed chain assembly 6,7 carrying and feeding the log forward, this chain being provided with supporting members 8 adapting to the shape of the log surface and carrying the log at a plurality of points and maintaining its unchanged position, the log being fed to the circular saws 3, clamped between said staying spikes 5 and supporting members 8. The supporting members 8 consist of spikes each turnable about a shaft 9 transverse to the direction of travel on the log and journalled to the feed chain 6,7. These spikes assume a position in which they touch the surface of the log and point obliquely forward as referred to the direction of travel of the log. The feed chain has been divided into two sections, one section 6 located before the sawblades 3 and a section 7 located after the sawblades 3, whereby the sidewise adjustment, and potential replacement, of the sawblades 3 is made easier.

The log 1 is fed into the saw machine from left to right direction as shown in FIG. 1, in between the feed and guide rollers 2 far enough to bring it into a position where it lies over the feed chain section 6 on its entire length. The supporting members 8 on the feed chain will be turned, by action of a triggering mechanism 10 located above chain section 6,, against the surface of the log as shown by the arrow 11, whereby the log remains lying supported by the supporting members 8. Above the log 1, similar turnable staying spikes 5 are present, which prevent the log from rising upwards. The log is now in a secured position, whereby it maintains its alignment throughout the sawing process.

Following after the sawblades 3 has been provided another feed chain section 7, which receives and further supports the fully sawn square timber. In front of the sawblades 3, there are furthermore provided the square sawing disks 12, which hew the log to become a square timber before the sawing by sawblades 3. On the ultimate end of the feed chain 6 has been provided a resetting means 13 for the supporting members 8, which by an inclined surface turns the supporting members 8 to be horizontal with reference to the feed chain. The feed chains 6 and 7 are furthermore adjustable vertically, as shown by arrows 14, consistent with the thickness of the logs being sawed.

It is obvious to a person skilled in the art that the invention is not confined to the example presented above and that it may vary within the scope of the claims below.

I claim:

1. A sawing machine for logs, comprising:

multiple spaced rollers which guide a log laterally to center it and feed it forward to at least one sawblade of the sawing machine;

a transporting chain assembly located between and under the multiple rollers for feeding the log to the sawblade, said transporting chain assembly extending both before and after the sawblade; and a staying chain provided above the log for staying the log by means of staying spikes turnably attached to the staying chain and acting on the log surface, said staying chain being located before and after said sawblade, wherein the transporting chain assembly below the log carries multiple turnable supporting members which adapt their position to the shape of the log's surface, and which supporting members support the log at a plurality of points and clamp the log between the transporting chain and the staying chain so as to maintain its unchanged horizontal and vertical position relative sawblade during its forward motion through the sawing machine.

2. A saw machine according to claim 1, wherein the supporting members consist of spikes turnable about a shaft journalled to the transporting chain transverse to the direction of travel of the log, and which supporting members assume a position pushing against the surface of the log and obliquely forward or backward with reference to the direction of travel of the log.

3. A saw machine according to claim 1, wherein the sawblades include a sawing disc located in front of circular sawblades.

4. A sawing machine according to claim 1, wherein the staying chain located above the log overlaps two sections of the transporting chain, one section being located before the sawblade and the other section located after the sawblade.

5. A saw machine according to claim 1, wherein a triggering mechanism is provided above the transporting chain section before the sawblades for turning the supporting members against the surface of the log.

6. A saw machine according to claim 1, wherein a resetting mechanism is provided at the ultimate end of the transporting chain section before the sawblades for turning the supporting members to a horizontal position with reference to the feed chain.

7. A sawing machine for logs, comprising:

(a) a circular sawblade adapted for longitudinally sawing a log transported through the machine;

(b) multiple spaced rollers located along sides of the log and which guide the log laterally to center it and help feed it forward to the sawblade;

(c) a transporting chain assembly located between and under said multiple rollers, said chain assembly including multiple turnable supporting members for supporting the log at a plurality of points and feeding the log to the sawblade, said transport chain assembly including two sections, one section being located before the sawblade and one section located after the sawblade; and (d) a staying chain provided above the log and provided with turnable staying spikes acting on the log's surface, said staying chain being located before and after said sawblade and overlapping the two sections of the transporting chain assembly, wherein the transporting chain assembly located under the log includes a triggering and resetting mechanism for turning the multiple turnable supporting members to adapt their position to the shape of the log surface and support the log at a plurality of points and clamp the log between the transporting chain and the staying chain, so as to maintain its unchanged position relative to the sawblade during its forward motion through the blade and the sawing machine.

* * * * *